United States Patent [19]

Bolton et al.

[11] Patent Number: 5,010,742

[45] Date of Patent: Apr. 30, 1991

[54] ACTUATION MECHANISM FOR VENT AND EXHAUST DOORS

[75] Inventors: Theodore S. Bolton, Liverpool; Curtis L. Tobin, Sr., Chittenango, both of N.Y.

[73] Assignee: Carrier Corporation, Syracuse, N.Y.

[21] Appl. No.: 153,745

[22] Filed: Feb. 8, 1988

[51] Int. Cl.[5] ..... F25D 23/12

[52] U.S. Cl. ..... 62/262; 98/94.2

[58] Field of Search ..... 62/262, 427; 98/94.2

[56] References Cited

U.S. PATENT DOCUMENTS

| | | | |
|---|---|---|---|
| 3,123,989 | 3/1964 | Wright | 62/427 |
| 3,152,456 | 10/1964 | Prendergast | 62/427 X |
| 3,194,028 | 7/1965 | Bell, Jr. | 62/427 X |
| 3,823,574 | 7/1974 | Bolton | 62/262 |
| 3,826,105 | 7/1974 | Marsteller | 62/262 |
| 3,921,416 | 11/1975 | Murnane et al. | 62/427 |
| 3,932,157 | 1/1976 | Bolton et al. | 62/427 X |
| 4,090,373 | 5/1978 | Lang et al. | 62/427 X |
| 4,524,588 | 6/1985 | Bond | 62/262 |
| 4,553,405 | 11/1985 | Napolitano et al. | 62/262 |

*Primary Examiner*—William E. Tapolcai

*Attorney, Agent, or Firm*—Dana F. Bigelow

[57] ABSTRACT

The indoor blower scroll structure includes integrally formed vent and exhaust port walls with associated doors attached thereto. A single actuator mechanism is also attached to the scroll structure and is mechanically linked to both doors to thereby provide a single and reliable actuation assembly, all of which is mounted on the scroll structure. In a preferred embodiment, the actuator comprises a single, lever actuated cam which directly engages levers on both the vent and exhaust doors.

20 Claims, 3 Drawing Sheets

ACTUATION MECHANISM FOR VENT AND EXHAUST DOORS

BACKGROUND OF THE INVENTION

This invention relates generally to air conditioning systems and, more particularly, to a mechanism for actuating the vent and exhaust doors of a room air conditioner.

A room air conditioner is a self-contained unit having outdoor and indoor sections which are divided by a transversely extending partition wall. The outdoor section includes a condenser coil and a fan for circulating outdoor air through the condenser coil to thereby cool the refrigerant flowing through the system. The indoor section includes an evaporator coil and a blower which draws in the relatively warm room air, passes it through the evaporator coil to be cooled, and then discharges the cooled air back into the room.

Rather than continuously recirculating the same room air, it is sometimes desirable to exhaust some of the stale room air to the outside. Further, it may be desirable, especially in cooler ambient temperature conditions, to bring in the outdoor air for distribution into the room. These functions have traditionally been accomplished with the use of exhaust and vent ports, respectively, which, when opened, allow the selective flow of air between the outdoor and indoor sections. The doors are commonly located in strategic positions so as to take advantage of the pressure differences to selectively cause the outdoor air to flow through the vent port into the indoor section or for the indoor air to flow through the exhaust port to the outdoor section.

Since the pressure differences are normally sufficient only for one or the other of the vent and exhaust functions but not for both simultaneously, it has become common practice to provide a single selector mechanism to operate both devices, with a single handle operating to open one door at a time. However, because of the need to locate the two doors in different locations, as required by the pressure drop needs discussed hereinabove, the control mechanism has normally been mounted on a different component from one or both of the doors. In some cases, even the vent and exhaust doors are mounted on different components. Typical of such devices is that shown in U.S. Pat. No. 3,823,574 assigned to the assignee of the present invention. While effective, these devices have been relatively complex and have traditionally involved a relatively large number of interconnecting parts. Thus, besides the obvious disadvantages of complicating the assembly and operation processes, the proper spacial interrelationships between the various parts have been found to be somewhat difficult to establish and maintain. That is, not only is there a tolerance stackup from the combination of the numerous parts, but the difficulties in maintaining proper alignment in operation are exacerbated by the fact that these various components are attached to different mounting members whose relative positions are difficult to control. For example, in the system described in the above mentioned patent, the doors are mounted to the partition but the operating levers are mounted to the control box. Since the position of the control box relative to the partition may vary, it may lead to an improper fit or operation of the control mechanism interconnecting the lever and the doors.

It is therefore an object of the present invention to provide an improved vent/exhaust door actuation mechanism.

Another object of the present invention is the provision in a room air conditioner for a reduced number of parts in the mechanism which operates the vent and exhaust doors.

Yet, another object of the present invention is the provision for maintaining the proper operational alignment between the various components of the vent and exhaust door actuation mechanism.

Yet, another object of the present invention is the provision for a vent/exhaust door mechanism which is easy and simple to manufacture and assemble, and is effective and reliable in use.

These objects and other features and advantages become more readily apparent upon reference to the following description when taken in conjunction with the appended drawings.

SUMMARY OF THE INVENTION

Briefly, in accordance with one aspect of the invention, both the vent and exhaust doors, as well as the entire actuating mechanism for operating those doors, are mounted to the same element. In this way, not only are the number of parts in the actuation mechanism minimized, but also the relative positions of the two doors and the actuating mechanism are controlled to thereby enhance the reliability and proper operation of the system.

In accordance with another aspect of the invention, a scroll structure is provided in the indoor section of a room air conditioner and both the vent and exhaust doors, as well as the operating mechanism therefor, are mounted on that scroll structure. The vent door is mounted on a transverse wall of the scroll structure, adjacent an opening in the partition wall, such that when the door is opened, outside air may pass from the outdoor section, through the opening in the partition and finally through the vent opening in the scroll structure to the indoor section. The exhaust door is mounted at the top of the scroll structure, and, when the door is opened, it provides fluid communication from the discharge opening of the blower wheel to the outdoor section. The actuation mechanism is mounted at the top portion of the scroll structure and is mechanically linked to both the vent and exhaust doors in such a way as to selectively open either one of those doors while leaving the other in the closed position.

By another aspect of the invention, the actuation mechanism comprises a single cam having an actuation lever at one end and a pair of camming surfaces near the other end thereof. Each of the camming surfaces engages an ear of one of the vent or exhaust doors, such that when the actuation lever is moved to one of three positions, only the vent door will be opened, only the exhaust door will be opened, or both of the doors will be closed. Biasing means is provided for each of the doors to urge them to their closed positions until the cam member causes them to open.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
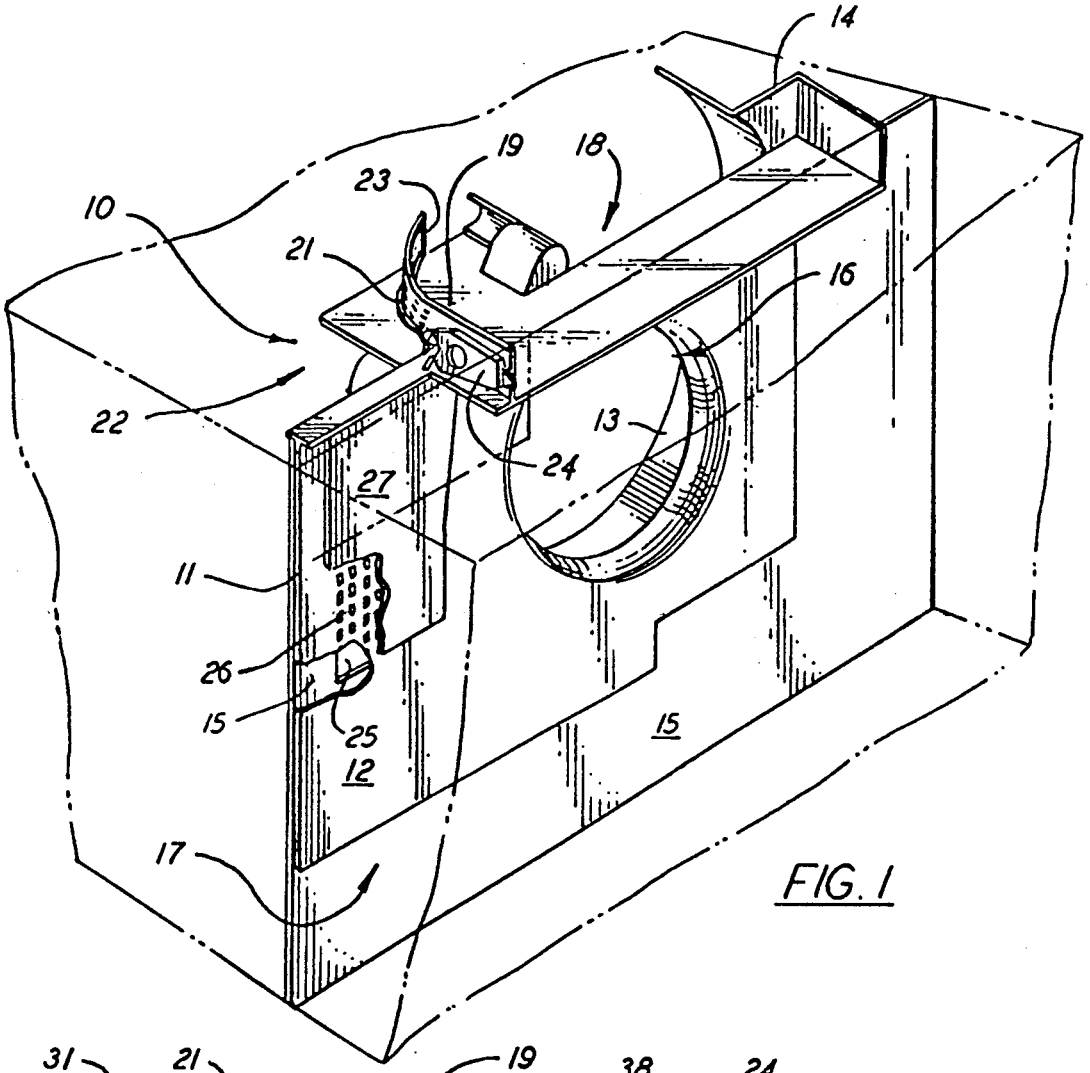
FIG. 1 is a perspective view of the scroll portion of a room air conditioner, with the present invention embodied therein.

Referring now to FIG. 1, the invention is shown generally at 10 as embodied in a scroll structure 11 which cooperates with a partition 15 to define the boundaries between the outdoor and indoor sections of the room air conditioner.

The scroll structure 11 comprises a planar wall member 12, a fan scroll member 13, and a fan discharge structure 14. A blower wheel (not shown) is rotatably disposed within the fan scroll member 13 with its axis aligned with that of the orifice 16 formed in the wall member 12. In operation, the blower wheel is rotated by its driving motor to draw return air from the room and cause it to flow first through the evaporator coil to be cooled, and then through the orifice 16, from where it is then directed radially outwardly into the fan discharge structure 14, and into the room. It will be recognized that when the blower is in operation, a relatively low pressure condition will exist in a portion of the indoor section (i.e. on the evaporator coil side of the planar wall member 12), which low pressure area is indicated by the numeral 17. Conversely, within another portion of the indoor section (i.e. on the discharge side of the blower), an area of relatively high pressure will exist within the fan discharge structure. That high pressure area is indicated generally by the numeral 18.

As will be seen, the scroll structure 11 is a unitary structure with the planar wall member 12 and the fan scroll 13 being integrally connected. This structure is preferably made of plastic and is formed in a conventional manner such as injection molding. As part of that integral structure, an exhaust wall 19 forms an integral part of the fan discharge structure 14 and extends upwardly to form one of the side boundaries the fan discharge air flow path. A plurality of openings 21 are formed in the exhaust wall 19 to provide fluid communication between the high pressure area 18 on one side of the exhaust wall 19 and an area within the outdoor section as indicated by the numeral 22, on the other side thereof. An exhaust door 23 is disposed on a high pressure side of the exhaust wall 19 to close off the air flow through the openings 21 in a manner to be described hereinafter. Opening and closing of the exhaust door 23 is accomplished by operation of an actuation member 24 mounted on the one side of the exhaust wall 19 as shown in FIGS. 1-5.

Formed in the planar wall member 12, in a location below the actuation member 24 is a plurality of vent openings 26 which provide fluid communication between the relatively higher pressure, outdoor section area 22 on one side of the planar wall member 12 and the low pressure area 17 on the other side thereof. The vent door 27 is mounted on the low pressure side of the planar wall member 12 and is selectively movable by way of the actuator 24 to selectively allow or prevent the flow of outdoor air through a partition opening 25 and the vent openings 26.

Referring now to FIGS. 2-5, mechanisms for biasing the exhaust door 23 and vent door 27 to their closed positions and for moving them to their open positions are shown. Forming an integral part of the exhaust door 23, at one end thereof, is a tab 28 which passes through and is mounted in an opening of the air exhaust wall 19. Mechanically attached to one side of the tab 28 is a leaf spring 29 having its other end engaged with a stationary reinforcing wall 31 extending from the air exhaust wall 19. The leaf spring 29 is installed in a tensed condition between the reinforcing 31 and the tab 28 so as to thereby bias the exhaust door 23 to the closed position.

The vent door 27 is installed with its upper edge engaging the bottom surface of the horizontal extension 32 of the planar wall member 12. From one end of the door upper edge a tab 33 extends upwardly through the horizontal extension 32 a shown. The vent door 27 is held in place by a tension spring 34 interconnected between a stationary support wall 36 and a connection tab 37 on one side of the door 27. The tension spring 34 acts to bias the door upper edge against the horizontal extension 32 and to bias the door to its closed position. The door 27 is opened by pivoting the door about its upper edge by moving the tab 33 in a manner to be described below.

Figure 2:
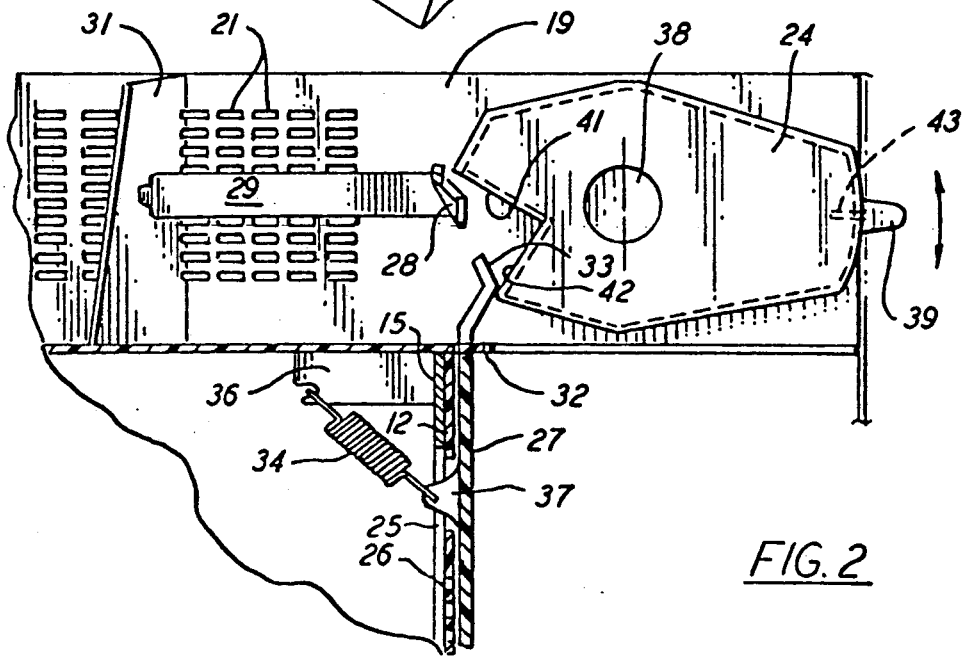
FIG. 2 is a partial side view thereof with the activation lever in the neutral position.
Figure 3:
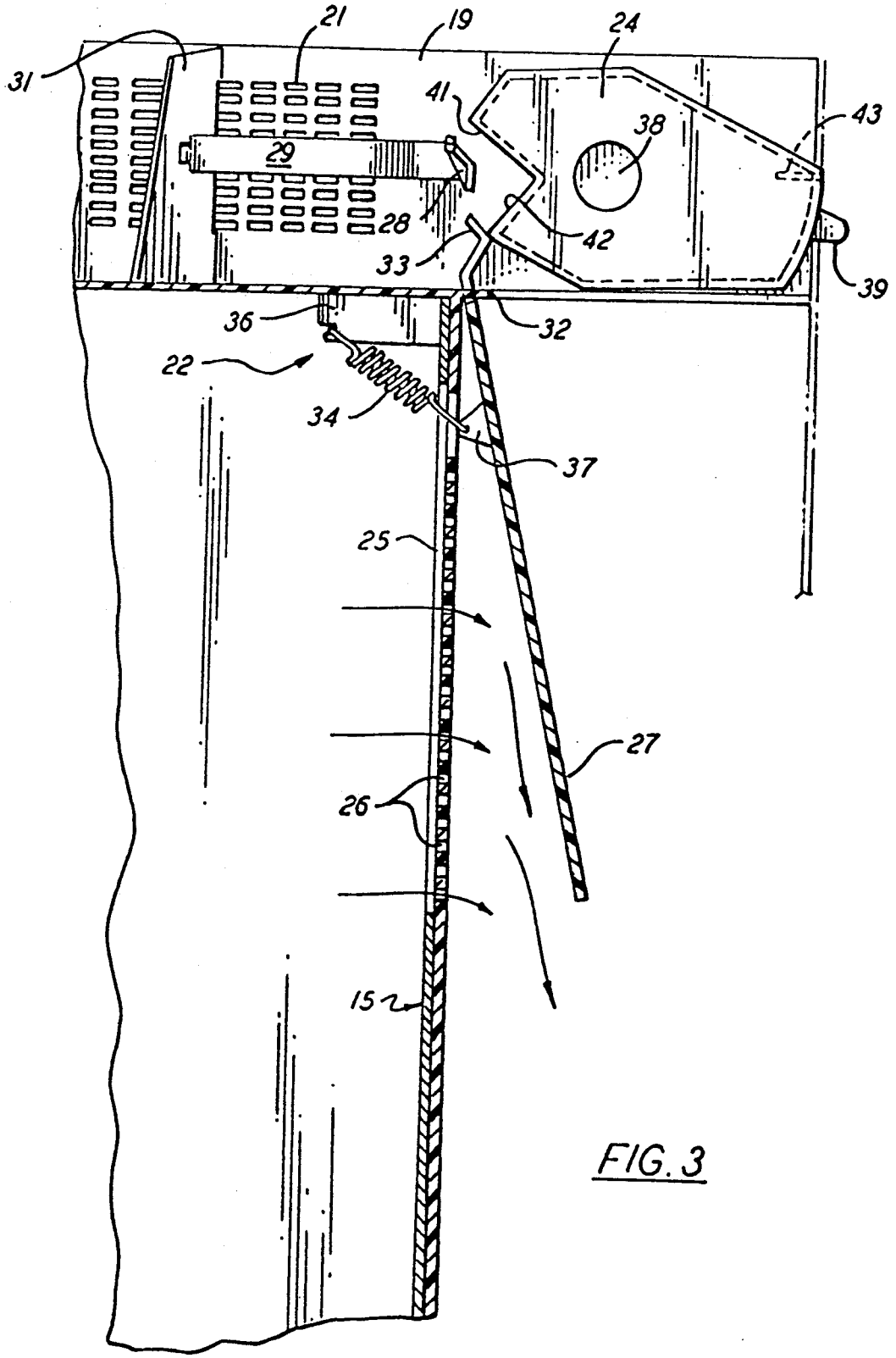
FIG. 3 is a partial side view thereof with the vent door in the open position.

The actuation member 24 is rotatably mounted at its axis 38, and has a handle 39, as well as cam surfaces 41 and 42. Disposed within the hollow, inner side of the actuation member 24 is a stop member 43 which is integrally attached to and extends outwardly from the air exhaust wall 19. This stop 43 functions to limit the upward and downward movement of the handle 39 to prescribed limits. Considering now the operation of the actuation member 24, during periods in which neither exhausting nor venting is desired, the actuation member 24 is placed in the neutral position as shown in FIG. 2, with both the exhaust door 23 and the vent door 27 being biased to the closed positions. When it is desired that outdoor air be vented directly into the indoor section, the handle 39 of the actuation member 24 is moved downwardly to thereby cause the cam surface 42 to engage the tab 33 to thereby open the vent door 27 as shown in FIG. 3. The stop member 43 prevents the handle 39 from being moved further and thereby establishes the final position of the cam surface 42. In this position, the over-center relationship of tab 33 and cam surface 42 is such that the spring 39 biases the actuation member in the clockwise direction against the stop 43. When venting is no longer desired, the handle 39 is simply moved backed to its neutral position to allow the tension spring 34 to close the vent door 27.

Figure 5:
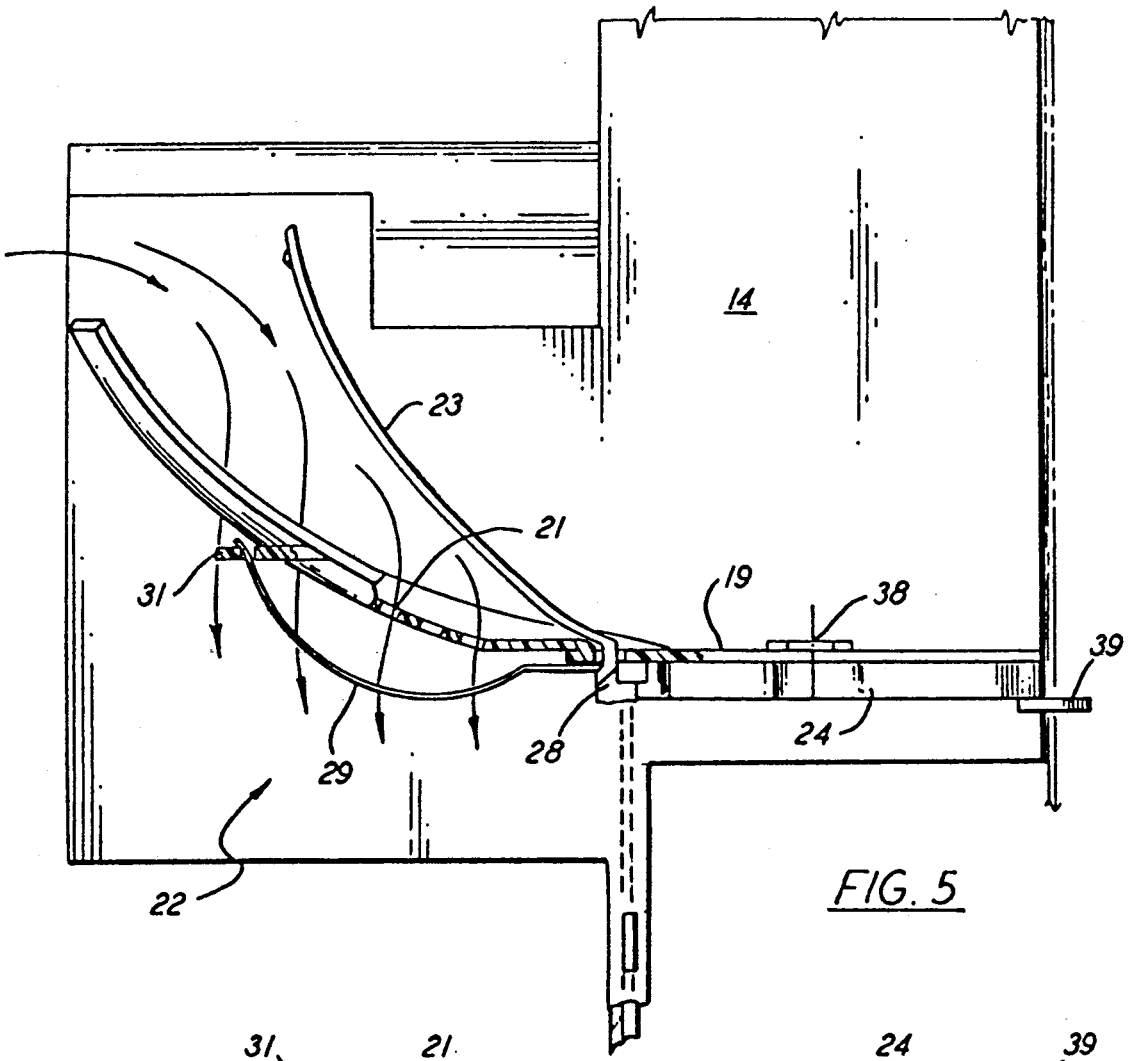
FIG. 5 is a top view thereof with the exhaust door in the open position.
Figure 4:
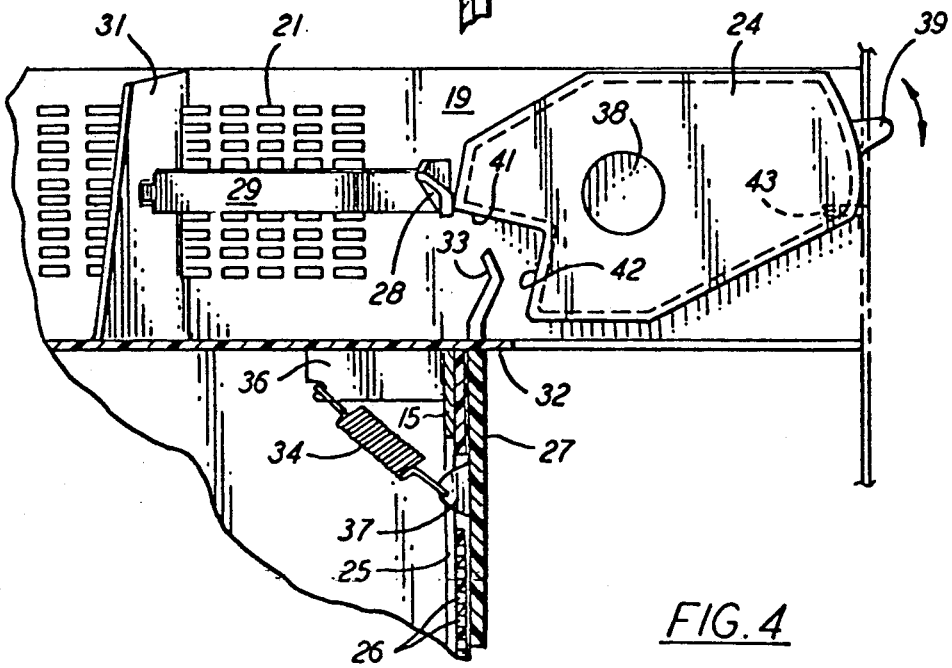
FIG. 4 is a partial side view thereof with the exhaust door in the open position.

When it is desired to exhaust air from the indoor section directly to the outdoor section, the handle 39 of the actuation member 24 is moved to the upper position as shown in FIGS. 4 and 5 such that the cam surface 41 operates to move the tab 28 against the bias of the leaf spring 29 to thereby open the exhaust door 23 and allow the air to flow as indicated by the arrows. Again, the stop member 43 functions to limit movement of the handle 39 and the over-center relationship of the tab 28 and cam surface 41 is such that the spring 29 tends to bias the actuation member 24 in the counterclockwise direction against the stop 43. The exhaust door 23 is closed by simply returning the handle 39 to the neutral position.

It will be recognized that, inasmuch as the actuator member 24 and the exhaust and vent doors 23 and 27 respectively, together with their interconnecting linkage, are all mounted to a single structure (i.e. the scroll structure 11), the proper positional relationships between those components can be maintained during and after the assembly process so as to ensure the proper operational characteristics of those components and their connecting linkage. With the spring 29 and 34, both the exhaust and vent doors 23 and 27 are held in place and biased to their closed positions when the handle 39 is in the neutral position. Further, because of the over-center relationships, the actuation member is biased with the handle 39 being urged toward the top or bottom positions when the respective exhaust or vent doors are open to thereby prevent accidental closing that could be caused by vibrations, bumping or the like.

What is claimed is:

1. In a room air conditioner of the type having a partition dividing indoor and outdoor sections and having vent and exhaust openings for exhausting room air into the outdoor section and for venting outdoor air into the indoor section an improved control mechanism comprising:

a scroll structure mounted in the indoor section and having the vent and exhaust openings integrally formed therewith, said vent opening being so disposed as to selectively provide fluid communication from said outdoor section to said indoor section, and said exhaust opening being so disposed so as to provide fluid communication from said indoor section to said outdoor section;

a vent door mounted on said scroll structure for selectively opening or closing said vent opening;

an exhaust door mounted to said scroll structure for selectively opening or closing said exhaust opening; and an actuator mechanism mounted to said scroll structure and mechanically linked to said vent and exhaust doors to selectively operate them between open and closed positions.

2. A control mechanism as set forth in claim 1 wherein said actuator mechanism includes a single lever to operate both said vent and exhaust doors.

3. A control mechanism as set forth in claims 2 wherein said lever is selectively movable to a first position wherein both said vent and exhaust doors are closed.

4. A control mechanism as set forth in claim 3 wherein said lever 1 is selectively movable to a second position wherein only the said vent door is opened.

5. A control mechanism as set forth in claim 2 wherein said lever is selectively movable to a third position wherein only said exhaust door is open.

6. A control mechanism as set forth in claim 1 wherein said actuation mechanism includes a cam with a pair of cam surfaces which engage lever portions of the respective vent and exhaust doors.

7. A control mechanism as set forth in claim 1 and including biasing means for biasing said vent and exhaust doors to the closed position.

8. A vent and exhaust door apparatus for a room air conditioner of the type having a partition partially defining indoor and outdoor sections and having vent and exhaust doors for selectively providing fluid communication therebetween, comprising;

a scroll structure associated with the indoor section and having both a vent wall portion and an exhaust wall portion for attaching the respective vent and exhaust doors thereto;

a vent port opening associated with the vent door in said vent wall portion to provide fluid communication between the outdoor and indoor sections;

an exhaust port opening associated with the exhaust door in said exhaust wall portion to provide fluid communication between the outdoor and indoor sections; and an actuator mechanism mounted on said scroll structure and mechanically linked to both the vent and exhaust doors to selectively move them between open and closed positions.

9. Vent and exhaust door apparatus as set forth in claim 8 wherein said vent wall portion is adjacent said partition and the partition includes an opening which registers with said vent opening.

10. A vent and exhaust door apparatus as set forth in claim 8 and including a blower wheel associated with said scroll structure for discharging air from said indoor section by way of an air discharge portion and further wherein said vent wall portion is disposed adjacent said air discharge portion.

11. A vent and exhaust door apparatus as set forth in claim 8 wherein said actuator mechanism includes a single lever to operate both the vent and exhaust doors.

12. A vent and exhaust door apparatus as set forth in claim 11 wherein said lever is movable to a first position wherein only the vent door is open.

13. A vent and exhaust door apparatus as set forth in claim 11 wherein said lever is movable to a second position wherein only said exhaust door is open.

14. A vent and exhaust door apparatus as set forth in claim 11 wherein said lever is movable to a third position wherein both the vent and exhaust doors are in closed positions.

15. A vent and exhaust door apparatus as set forth in claim 8 wherein said actuator mechanism includes a cam that directly engages a portion of the vent door.

16. A vent and exhaust door apparatus as set forth in claim 8 wherein said actuator mechanism includes a cam which directly engages a portion of the exhaust door.

17. A vent and exhaust door apparatus as set forth in claim 8 wherein said actuator mechanism includes a cam with a pair of cam surfaces which engage respective portions of the vent and exhaust doors.

18. A vent and exhaust door apparatus as set forth in claim 8 and including biasing means for biasing the vent and exhaust doors to their closed positions.

19. A vent and exhaust door apparatus as set forth in claim 12 and including biasing means for biasing said lever to remain in said first position.

20. A vent and exhaust door apparatus as set forth in claim 13 and including biasing means for biasing said lever to remain in said second position.

* * * * *